US005329850A

United States Patent [19]

Duarte

[11] Patent Number: 5,329,850

[45] Date of Patent: Jul. 19, 1994

[54] METERING ROLLER FOR A LITHOGRAPHIC PRINTING PRESS

[76] Inventor: Eduardo Duarte, 528 Rawls Cir., Irving, Tex. 75061

[21] Appl. No.: 911,327

[22] Filed: Jul. 10, 1992

[51] Int. Cl.[5] ..... B41F 7/26; B41F 7/32

[52] U.S. Cl. ..... 101/148; 101/450.1

[58] Field of Search ..... 101/148, 147, 349, 350, 101/363, 348, 352, 483, 493, 450.1; 118/258, 259, 261; 492/43, 44

[56] References Cited

U.S. PATENT DOCUMENTS

| | | | |
|---|---|---|---|
| 2,199,228 | 4/1940 | Obenshain et al. . | |
| 2,429,670 | 10/1947 | Crews . | |
| 2,690,119 | 9/1954 | Black . | |
| 2,891,470 | 6/1959 | Rowe et al. . | |
| 2,996,981 | 8/1961 | Reinartz et al. . | |
| 3,008,407 | 11/1961 | Roberts et al. . | |
| 3,131,629 | 5/1964 | Barnes . | |
| 3,343,484 | 9/1967 | Dahlgren | 101/148 |
| 3,613,575 | 10/1971 | Kantor | 101/148 |
| 3,986,452 | 10/1976 | Dahlgren | 101/148 |
| 4,411,193 | 10/1983 | Hess . | |
| 5,016,530 | 5/1991 | Palmatier | 101/148 X |

FOREIGN PATENT DOCUMENTS

| | | | |
|---|---|---|---|
| 2849096 | 5/1980 | Fed. Rep. of Germany | 101/148 |
| 2513181 | 3/1983 | France | 101/148 |

*Primary Examiner*—J. Reed Fisher

*Attorney, Agent, or Firm*—Crutsinger & Booth

[57] ABSTRACT

A method for maintaining, without using alcohol, a uniform film of dampening fluid on a lithographic printing press dampening roller. Said roller comprises a resilient surface with grooves helically formed about the roller surface. Said roller is positioned in a pressure indented relation to a smoothly finished transfer roller having a hydrophilic surface, creating an area of differential pressure along said grooves at the point of contact, or nip, between the rollers. Upon rotation of the rollers, excess water is transferred to the low pressure regions near the grooves of the nip and then to the end of the roller where it is returned to the dampening fluid pan.

11 Claims, 2 Drawing Sheets

METERING ROLLER FOR A LITHOGRAPHIC PRINTING PRESS

BACKGROUND

Heretofore it has been standard procedure for lithographic printing presses to use dampening fluid which preferably comprises a mixture of water and water soluble, volatile, organic liquid such as alcohol, esters, ketones and similar compounds which are compatible with, and receptive to, oil-based ink. Commercial grade isopropyl alcohol is preferably employed because of its economy and ready availability. Such material is molecularly compatible with ink because the vehicle of the ink is organic material and the dampening fluid containing alcohol is organic material.

It has been found that mixing 10 to 25% alcohol with water works satisfactorily for most lithographic printing operations. Dampening fluid containing alcohol is quickly absorbed in the inking system because it is ink compatible and rides on and into the surface of ink coated form rollers in a uniformly thin layer and evaporates quickly. Upon evaporation, alcohol does not cause oxidation as does water and, furthermore, it provides a cooling agent for the rollers running in contact. There are numerous other important reasons for using alcohol.

Recently, concern has developed that evaporation of alcohol may damage the environment. However, if alcohol is not mixed with the dampening fluid, then "ridging" occurs whereby water rings are formed on the chrome roller resulting in unwanted lines and "ghosting" on the final printed sheets.

"Ghosting" is the variation in the color of the printed image on the sheet resulting from an improper ink-water balance on the surface of the printing plate. An improper ink-water balance may result from the accumulation of excess ink in streaks on inker form rollers in areas corresponding to non-image areas on the printing plate. A similar phenomena results when "water streaks" in a non-uniform film of dampening fluid on the chrome roller are transferred to the dampener form roller which causes "ridging" or streaking on the plate and the printed sheet.

SUMMARY OF INVENTION

The invention disclosed herein relates to an improved method to control, without the use of alcohol, the uniformity of the dampening fluid on the dampener form roller in a lithographic printing system.

The dampener comprises a pair of rollers mounted in pressure indented relation to form a metering nip. A metering roller with a resilient surface and a transfer roller with a smoothly finished, hydrophilic surface rotate such that adjacent surfaces of the rollers meter a film of dampening fluid through the metering nip. The hydrophylic transfer roller rotates such that its surface speed is different from the surface speed of a form roller to which a metered film of dampening fluid is applied and transferred to the printing plate.

The resilient surface of the metering roller has a helical groove formed thereon, such that adjacent areas of differential pressure are formed longitudinally of the nip and, upon rotation of the rollers, dampening fluid is transferred longitudinally of the nip. A very thin, almost microscopic, helical shaped bead of dampening fluid is formed on the hydrophylic transfer roller to periodically provide a slight excess of dampening fluid to spaced portions of the nip between the hydrophylic transfer roller and the form roller. Slippage in the nip between the hydrophylic transfer roller and the form roller spreads the microscopic bead of dampening fluid to form a uniform film of dampening fluid which is applied immediately by the form roller to the printing plate.

Two embodiments of the dampening system are disclosed. In the first embodiment, dampening fluid is initially applied to the hydrophylic transfer roller. In the second embodiment, dampening fluid is initially applied to the resilient metering roller.

The primary object of the invention is to provide a dampening system for lithographic printing which does not require the use of alcohol which, upon evaporation, may be ecologically undesirable.

DESCRIPTION OF THE DRAWINGS

Drawings of two embodiments of the invention are annexed hereto so that the invention may be better and more fully understood, in which.

Numeral references are employed to designate like parts throughout the various figures of the drawing.

BRIEF DESCRIPTION OF PREFERRED EMBODIMENTS

Figure 1:
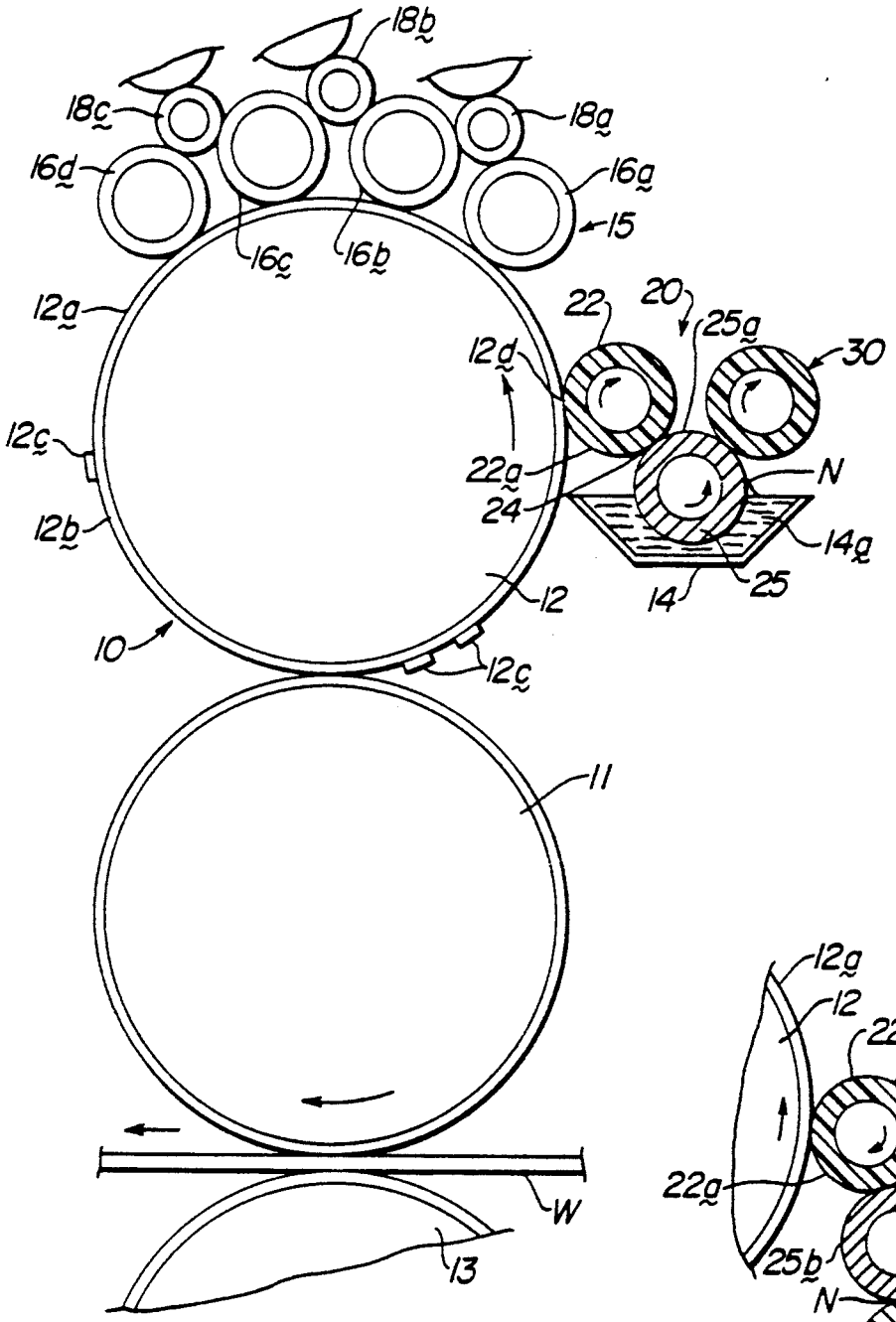
FIG. 1 is a diagrammatic view of a first embodiment illustrating the relative positions of a source of dampening fluid, a metering roller, a transfer roller and a form roller in a lithographic printing press.

Referring to FIG. 1 of the drawing, the numeral 10 generally designates a lithographic printing press comprising a plate cylinder 12, a blanket cylinder 11, an impression cylinder 13, an inker 15 and a dampening system 20. The plate cylinder 12, blanket cylinder 11, impression cylinder 13 and inker 15 are of conventional design and form no part of the invention except in combination with the dampening system 20. The particular printing press illustrated in FIG. 1 is a lithographic offset press which prints on a web W. However, the improved dampening system 20 may be used in combination with other presses.

The inker 15 comprises a plurality of form rollers 16*a*, 16*b*, 16*c* and 16*d* urged into pressure indented relation with a lithographic printing plate 12*a* carried on the surface of plate cylinder 12. Vibrator rollers 18*a*, 18*b* and 18*c*, which oscillate longitudinally, form a portion of an ink train, not shown, over which ink is delivered to form rollers 16*a*–16*d*.

The improved dampening system 20 comprises a dampening fluid form roller 22 having a smooth resilient surface, a transfer roller 25 having a hard hydrophilic surface and a metering roller 30 having a resilient surface.

Figure 2:
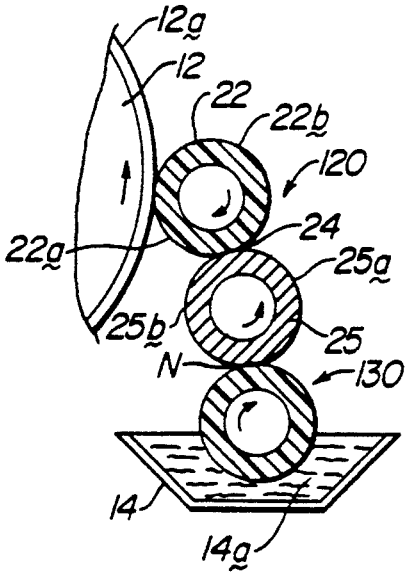
FIG. 2 is a diagrammatic view similar to FIG. 1 of a second embodiment with the metering and transfer rollers of a lithographic printing press repositioned with respect to the source of dampening fluid.

The embodiment of the dampening system generally designated by the numeral 20 in FIG. 1 of the drawing and the embodiment of the dampening system generally designated by the numeral 120 in FIG. 2 of the drawing differ primarily in the position of metering roller 30 and metering roller 130 relative to transfer roller 25.

In the embodiment of the dampening system illustrated in FIG. 1 of the drawing, a portion of the surface of transfer roller 25 is submerged in dampening fluid 14*a* in a pan 14. In the embodiment of the invention illustrated in FIG. 2 of the drawing, a portion of the surface of metering roller 130 is submerged in dampening fluid 14*a* in pan 14.

In the modified form of the invention illustrated in FIG. 2 of the drawing, the resilient surface of dampener form roller 22 is urged into pressure indented relation with a printing plate 12*a* carried on the surface of plate cylinder 12. Transfer roller 25 having a hard hydrophilic surface is urged into pressure indented relation with the resilient surface on dampening fluid form roller 22 and into pressure indented relation with the resilient surface on metering roller 130.

The general roller arrangements illustrated in FIGS. 1 and 2 of the drawing are well known to persons having ordinary skill in the art. Reference is made to U.S. Pat. No. 3,343,484 which discloses a roller arrangement similar to that of the embodiment illustrated in FIG. 1 of the drawing and a roller drive system for driving the rollers at different surface speeds. The patent also discloses structure for adjusting pressure between surfaces of the respective rollers and skewing the metering roller relative to the transfer roller for controlling pressure along the length of the rollers. The disclosure of U.S. Pat. No. 3,343,484 is incorporated herein by reference in its entirety for all purposes.

Reference is made to U.S. Pat. No. 3,986,452 for a roller arrangement similar to that of the embodiment illustrated in FIG. 2 of the drawing in which the metering roller is positioned in the pan. The disclosure of U.S. Pat. No. 3,986,452 is incorporated herein by reference in its entirety for all purposes.

The dampening fluid form roller 22 in the embodiments illustrated in FIGS. 1 and 2 may be eliminated if it is deemed expedient to do so, in which case the surface of transfer roller 25 would be positioned in pressure indented relation with the first inker form roller 16*a* as disclosed in U.S. Pat. No. 3,986,452.

Transfer roller 25 is preferably a metal roller having an exterior chrome plated surface which is highly machined and polished to form a smooth surface. The surface is treated to provide a hydrophilic surface which is receptive to dampening fluid and which rejects ink in the presence of dampening fluid. It has been found that the surface of the transfer roller 25 so treated will pick up and carry a uniform film 25*a* of moisture from the nip N between the transfer roller 25 and the metering roller 30.

Figure 4:
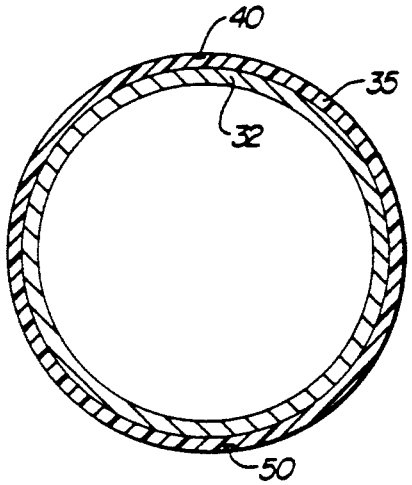
FIG. 4 is a cross-sectional view taken along line 4—4 of FIG. 3.
Figure 3:
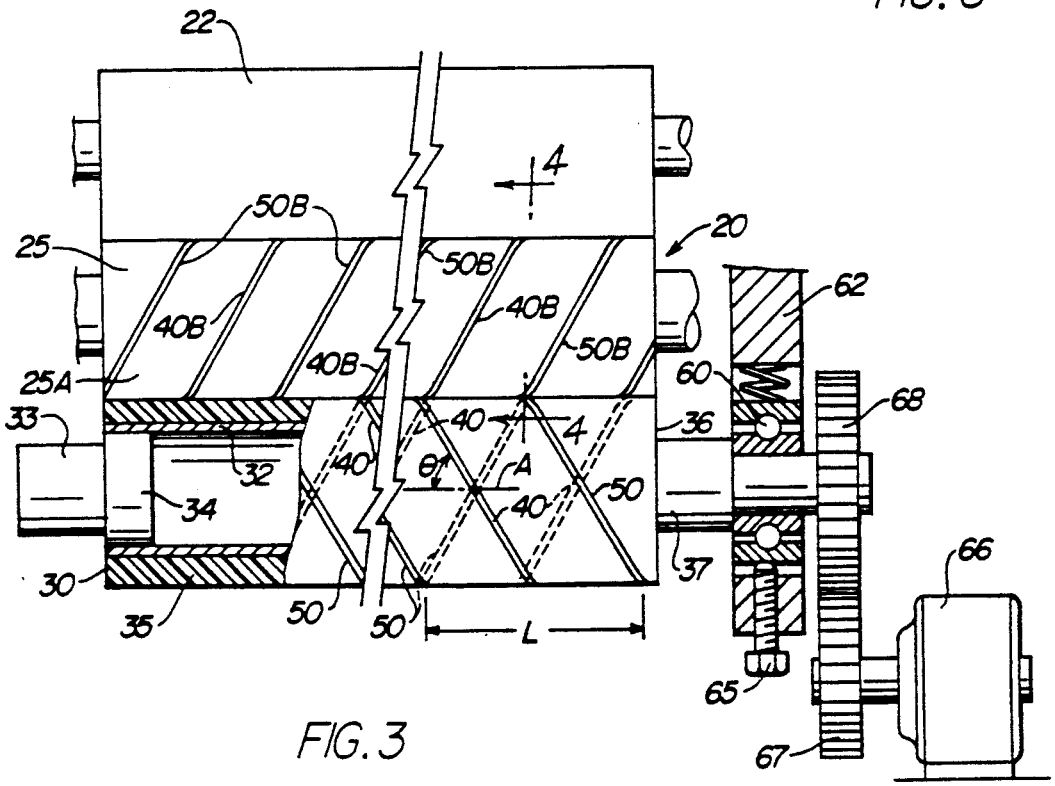
FIG. 3 is a fragmentary elevational view, parts being broken away to more clearly illustrate details of construction, of a metering roller, transfer roller and dampener form roller.

As illustrated in FIGS. 3 and 4, the metering roller 30 preferably comprises a hollow tubular sleeve 32 having cylindrical end plugs 34 and 36 extending into opposite ends thereof. End plugs 34 and 36 have stub shafts 33 and 37 formed thereon for supporting roller 30 in conventional bearings 60 mounted in throw-off links 62 or side frames (not shown) of a conventional dampening system.

The length of metering roller 30 may vary depending upon the size of the printing press and the maximum width of the sheet or web which is to be printed in the press. In the illustrated embodiment, the resilient cover 35 on metering roller 30 has a length of 13⅜ inches and an outside diameter of 2½ inches. The thickness of the resilient cover 35 is, for example, 3/16 of an inch.

Generally, the transfer roller 25 and metering roller 30 are geared together such that adjacent surfaces move in the same direction at the same or different surface speeds. The gear train is generally driven by a separate variable speed motor 66 permitting adjustment of the speed of rotation of gears 67 and 68 and consequently the relative surface speed of transfer roller 25 relative to the surface speed of form roller 22. By increasing or decreasing the speed of the dampener, the rate at which dampening fluid is applied by the transfer roller 25 to form roller 22 is controlled.

The dampening system 20 is a liquid applicator system adapted for use in conjunction with inker apparatus 15 for applying dampening fluid and ink to the lithographic printing plate 12*a* in the printing press 10.

Dampening fluid may be initially applied to the transfer roller 25, as illustrated in FIG. 1 by submerging a portion of the surface of the transfer roller 25 in dampening fluid 14*a* in dampening fluid pan 14; or to the metering roller 130, as illustrated in FIG. 2, by submerging a portion of the surface of the metering roller 130 in dampening fluid 14*a*; or to both the transfer roller 25 and the metering roller 30 simultaneously by spraying (not shown) dampening fluid into the metering nip N. Upon rotation of the roller submerged in the dampening fluid, the fluid is transferred to and floods the nip N between adjacent surfaces of the transfer and metering rollers. In the embodiment of FIG. 1, the thickness of the film 25*a* of dampening fluid on transfer roller 25 is adjusted by controlling the pressure between the transfer and metering rollers in the metering nip N. In the embodiment of FIG. 2, the thickness of the film 25*a* of dampening fluid on transfer roller 25 is adjusted by controlling the pressure between the transfer and metering rollers in the metering nip N, and also by controlling the surface speed of the metering roller 130, which supplies dampening fluid to nip N, relative to the surface speed of the transfer roller 25. The metered film 25*a* of dampening fluid is rotated to contact the surface of an ink film on the surface of form roller 22 or 16*a* in pressure indented relation to the lithographic printing plate 12*a*. The printing plate 12*a* has hydrophilic, or water receptive, non-image areas 12*b* and oleophilic, or ink receptive image areas 12*c* formed on the surface thereof.

At the nip 12*d* between the printing plate 12*a* and form roller 22 or 16*a*, depending upon the placement of the transfer roller 25 of the dampening system 20, a metered film 22*a* of dampening fluid on the dampener form roller splits and dampening fluid is transferred to the surface of the printing plate 12*a* and is distributed to form a thin film of dampening fluid over hydrophilic non-image areas 12*b* on the printing plate. The portion 22*b* of the metered film of dampening fluid which remains on the surface of the dampener form roller 22 is carried back to the nip 24 between the dampener form roller and the transfer roller 25.

When the quantity of alcohol or other volatile surface tension-reducing agent is decreased or eliminated from the dampening fluid, "ridging" occurs in the form of circular streaks of excessive dampening fluid on the hydrophilic surface of the transfer roller 25 and on the resilient surface of the metering roller 30.

The improved metering roller, generally designated by the numeral 30 in the embodiment illustrated in FIG. 1 and by the numeral 130 in the embodiment illustrated in FIG. 2 of the drawing, is configured to transfer a small amount of the dampening fluid in the flooded metering nip N toward an end of the roller to prevent accumulation of contaminants in the metering nip N.

The groove 40 in the resilient surface 35 of metering roller 30 results in the formation of a thicker film 25*a* on the transfer roller 25 than would be expected at the same pressure when using a smooth surfaced metering roller. However, the thickness of the film 25*a* may be controlled by adjusting screw 65.

When film 25*a* on transfer roller 25 is thick, the surface speed of transfer roller 25 is reduced increases slippage in the nip 12*d* between transfer roller 25 and dampener form roller 22 to controllably apply a thin film of dampening fluid to the form roller. This results in eliminating the bands of water streaks which cause "ridging" on the surfaces of transfer roller 25 and metering roller 30. When the water streaks disappear, the streaks of color variation on the printed sheets disappear also.

Figure 6:
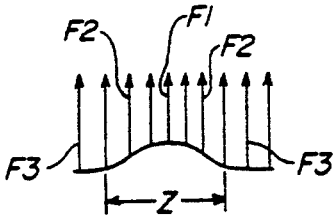
FIG. 6 is a force vector diagram illustrating the distribution of forces along a portion of the nip near the groove between the metering roller and transfer roller.

FIG. 6 of the drawing is a vector diagram illustrating the difference in the magnitude of pressure between adjacent surfaces of the transfer roller 25 and metering roller 30 in the vicinity of groove 40. It should be noted that the bottom surface 43 of groove 40 is urged into pressure indented relation with the hydrophilic surface on transfer roller 25 such that the pressure between the bottom 43 of groove 40 and the surface of roller 25 has a magnitude of force F1. However, the magnitude of force F2 adjacent opposite edges 42 and 44 of groove 40 gradually increases to a maximum force F3 at locations spaced from groove 40. This creates a zone "Z" of reduced pressure in the nip which carries an increased amount of dampening fluid. This area of reduced pressure moves transversely along the surface of transfer roller 25 as metering roller 30 rotates thereby forming a spiral shaped bead 40B of dampening fluid on the surface of transfer roller 25. Slippage between the surface of the form roller 22 and the film 25*a* of dampening fluid having the spiral shaped bead 40B formed therein causes the film of dampening fluid to be smooth and uniformly applied to the surface of the form roller 22.

In the present invention, the resilient cover 35 has at least one groove 40 and preferably from one to five grooves formed in its surface. Two grooves 40 and 50, are illustrated in FIGS. 3 and 4. Grooves 40 and 50 are helical, or angularly inclined relative to axis A of the roller 30.

Preferably, the grooves 40 and 50 should be approximately 1000th inch deep and 1,000th inch wide. With greater depth and/or widths water passing through the nip N results in a larger bead 40B and consequently a less uniform film of dampening fluid 25A on the transfer roller 25. Furthermore, resilient cover 35 should have a shore A durometer of from 18–30 to properly distribute the forces at the nip N about the groove.

The angle $\theta$ of the grooves are to be from approximately 20°–80 ° from the longitudinal axis A of metering roller 30. Two grooves at an angle 8 of 60° relative to axis A provides satisfactory results. Larger angles of inclination $\theta$ may necessitate fewer grooves; i.e., as the angle $\theta$ decreases from 80° to 20°, the number of grooves required may increase from one to five. Grooves 40 may be right hand grooves, left hand grooves or right and left hand grooves formed on opposite sides of a centerline through the printing press. The grooves may be used in any length of metering roller 30.

Upon movement of the resilient surface 35 through metering nip N, adjacent areas of differential pressure, as diagrammed in FIG. 6, are formed longitudinally of nip N to transfer a portion of the liquid longitudinally of the metering nip N.

Figure 5:
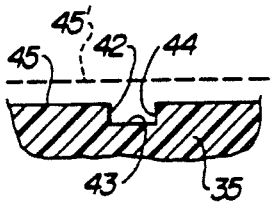
FIG. 5 is an enlarged fragmentary cross-sectional view illustrating a portion of the resilient cover on the metering roller.

As best illustrated in FIGS. 3 and 5 of the drawing, one or more spiral shaped grooves 40 and 50 are formed in the outer surface of a resilient cover 35 which is bonded to the outer surface of the tubular sleeve 32.

Each groove 40 and 50 preferably has a spiral, coiled form of a helix curved in the shape of a screw thread on the cylindrical cover 35. Grooves 40 and 50 are in the form of a curve formed by a straight line on a plane that is wrapped around cylinderical cover 35 and inclined at a lead angle $\theta$ relative to the longitudinal axis "A" of the cylinderical roller 30. The pitch or lead distance is the distance "L" measured longitudinal of cylindrical surface 35 for one convolution of each groove 40 or 50 to encircle the cylinderical cover 35. Preferably angle $\theta$ is such that the length of the resilient cover 35 on metering roller 30 is an integral multiple of the pitch "L" so that the number of grooves functioning at the nip N between the transfer roller 25 and the metering roller 30 is constant throughout an entire revolution of the rollers.

Groove 40 has a substantially flat bottom 43, having a width of, for example, in a range of 0.001 to 0.005 inches, flanked by substantially radially extending sides 42 and 44.

Groove 40 is formed in the surface 45' of roller 30 to a predetermined depth, for example, 0.003 inches. The surface 45' of roller 30 is then ground to form a smooth surface 45 through which groove 40 extends a distance of, for example, 0.001 inches.

Use of the roller 30 in dampening system 20 or dampening system 120 provides a new and improved method of applying dampening fluid to a printing plate 12*a* in a printing press 10. Surfaces of the metering roller 30 and the transfer roller 25 are urged into pressure indented relation to form a metering nip N. The rollers are rotated such that the dampening fluid is carried by the surface of at least one of the rollers through the metering nip N. Groove 40 forms a zone "Z" of differential pressure intermediate opposite ends of the metering nip N. The zone "Z" of differential pressure moves longitudinally of the metering nip N as the rollers rotate for transferring a portion of the dampening fluid longitudinally of the metering nip N toward the ends of the rollers 25 and 30 to prevent accumulation of contaminants in the dampening fluid adjacent the metering nip N.

As diagrammatically illustrated in FIG. 3 of the drawing, microscopic beads 40B and 50B of dampening fluid are formed on the surface of the film 25A of dampening fluid on the hydrophilic chrome roller 25. These microscopic beads 40B and 50B are not visible under normal operating conditions. However, if the hydrophilic transfer roller 25 is running too fast relative to the surface speed of form roller 22, excessive dampening fluid is applied to the form roller 22 and to the printing plate 12 and a pattern of color variation corresponding to the pattern of grooves 40 and 50 on metering roller 30 is visible on the printed sheet. As the surface speed of transfer roller 25 is reduced, increasing the slippage between the transfer roller 25 and form roller 22 the pattern of grooves 40 and 50 disappears from the printed sheet. Thus, grooves 40 and 50 form beads 40B and 50B of dampening fluid similar to "water streaks" which normally result in "ridging" on a printed sheet. However, beads 40B and 50B are formed such that adjusting the surface speed of transfer roller 25 controls or eliminates "ridging" on the printed sheet. However, water streaks extending circumferentially around transfer roller 25 and metering roller 30 cannot be controlled by adjusting the surface speed of transfer roller 25 relative to the form roller 22.

Forming a groove 40 at a lead angle $\theta$ of 90° is substantially the same as "water streaks" which have been observed heretofore which result in uncontrolled "ridging".

The depth, width, lead angle $\theta$ and the number of grooves 40 formed in metering roller 30 may vary for different configurations of dampeners and printing presses.

Pressure adjustment screw 65 urges the resilient surfaced metering roller 30, having a spiral groove 40 formed in the surface thereof, into a pressure indented relation with the hydrophilic surface on transfer roller 25. Variable speed motor 66 and gears 67 and 68 rotate metering roller 30 and 130 such that the portion 43 of groove 40 in the resilient roller surface 35 in the metering nip N moves longitudinally of the nip N for pumping contaminants to the end of dampening fluid pan 14 for removal from the dampening system.

Two preferred embodiments of the invention have been described. However, it should be readily apparent that other and further embodiments may be devised without departing from the spirit and scope of the appended claims.

Having described my invention, I claim:

1. A method of applying dampening fluid which is essentially free of alcohol to a printing plate in a lithographic printing press comprising the steps of:

urging surfaces of a metering roller and a transfer roller into pressure indented relation to form a metering nip;

rotating said transfer roller and said metering roller such that dampening fluid is carried by the surface of at least one of the rollers through said metering nip;

forming a zone of differential pressure intermediate opposite ends of said metering nip;

moving said zone of differential pressure longitudinally of said metering nip for transferring a portion of the dampening fluid longitudinally of said metering nip toward the end of said rollers to form a spiral shaped bead of dampening fluid on the surface of one of the rollers at said metering nip; and slipping the surface of the roller having said spiral shaped bead relative to a form roller for moving the bead of dampening fluid through a second nip to apply a uniform film of dampening fluid to said form roller.

2. The method of claim 1, the steps of forming a zone of differential pressure comprising the steps of:

urging a resilient surfaced roller having a groove formed in the surface thereof into pressure indented relation with a hydrophilic surface; and rotating said resilient surfaced metering roller such that the portion of the groove in the resilient roller surface in the metering nip moves longitudinally of said nip upon rotation of said metering roller.

3. A dampening system for a lithographic printing press comprising:

a pair of rollers mounted for rotation about spaced axes, at least one of said rollers having a resilient cover and a resilient surface;

means urging surfaces of said rollers into pressure indented relation to form a metering nip;

means supplying liquid to said metering nip; and means rotating one of said rollers such that adjacent surfaces of said rollers meter a film of liquid through said metering nip, said resilient cover having a helical groove formed therein, said helical groove being angularly inclined relative to the axis of the roller, such that adjacent areas of differential pressure are formed longitudinally of said metering nip upon movement of said resilient surface through said metering nip to transfer an effective amount of the liquid to form a spiral shaped bead of dampening fluid on one of the rollers.

4. A dampening system for a lithographic printing press according to claim 3, one of said pair of rollers comprising:

a transfer roller having a smooth hydrophilic surface.

5. A dampening system for a lithographic printing press according to claim 3, at least one of said pair of rollers comprising:

a metering roller having a rigid tubular core, said resilient cover being formed on said rigid tubular core of said metering roller, said resilient cover being formed of material having a Shore A durometer in a range of 18 to 30.

6. A dampening system for a lithographic printing press according to claim 5, said cover having a thickness in a range of $\frac{1}{8}$ to $\frac{3}{4}$ inch.

7. A dampening system for a lithographic printing press according to claim 3, said means rotating one of said rollers such that adjacent surfaces of said rollers meter a film of liquid through said metering nip comprising:

drive means rotating said rollers at different surface speeds such that slippage occurs between adjacent surfaces of said rollers in said metering nip.

8. A dampening system for a lithographic printing press according to claim 3, said means urging surfaces of said rollers into pressure indented relation to form a metering nip; comprising:

means for adjusting pressure between adjacent surfaces of said rollers in said metering nip.

9. A dampening system for a lithographic printing press according to claim 3, said means supplying liquid to said metering nip comprising:

a pan containing dampening fluid, said pan being positioned such that a surface on one of said rollers dips into the dampening fluid.

10. A dampening system for a lithographic printing press according to claim 8, said means supplying liquid to said metering nip comprising:

a pan containing dampening fluid, said pan being positioned such that a surface on one of said rollers dips into the dampening fluid.

11. A dampening system for a lithographic printing press comprising:

a transfer roller having a hard hydrophilic surface;

a metering roller having a resilient surface, the surface of at least one of said rollers having a smooth continuous groove extending spirally around said one roller surface, said groove having ends terminating adjacent opposite ends of said one roller;

means urging spaced portions of the bottom surface of said spiral groove into pressure indented relation with said hard hydrophilic surface to form a metering nip such that the profile of the magnitude of pressure across the width of the portion of the groove which is urged into pressure indented relation with said hydrophilic surface along the length of said bottom surface is substantially uniform and such that pressure along the length of said metering nip between said portions of said groove is substantially uniform to form spaced zones of differential pressure along said metering nip.

* * * * *